United States Patent [19]

Hesch et al.

[11] Patent Number: 4,557,647

[45] Date of Patent: Dec. 10, 1985

[54] MULTIPLANAR SUPPORT BEAM FOR HITCH PIVOT MOUNT

[75] Inventors: Harold E. Hesch, St. John, Ind.; Phillip G. Przybylinski, Shererville, Ill.

[73] Assignee: Pullman Standard Inc., Chicago, Ill.

[21] Appl. No.: 519,846

[22] Filed: Aug. 3, 1983

[51] Int. Cl.[4] ..... B60P 3/07

[52] U.S. Cl. ..... 410/58; 410/56

[58] Field of Search ..... 410/56-64; 248/500, 514, 536; 403/68, 79, 157

[56] References Cited

U.S. PATENT DOCUMENTS

| | | | |
|---|---|---|---|
| 3,164,346 | 1/1965 | Bateson | 410/61 X |
| 3,289,987 | 12/1966 | Candlin, Jr. et al. | 410/62 X |
| 3,358,955 | 12/1967 | Wille et al. | 410/64 |
| 3,539,141 | 11/1970 | Mowatt-Larssen | 410/64 |
| 3,653,621 | 4/1972 | Ferris et al. | 410/59 X |
| 4,074,633 | 2/1978 | Hicks, Jr. et al. | 410/61 |
| 4,264,250 | 4/1981 | Niggemeier | 410/58 |

*Primary Examiner*—Randolph A. Reese

*Attorney, Agent, or Firm*—Richard J. Myers & Assoc., Ltd.

[57] ABSTRACT

A rear pivot mount assembly for a fifth wheel hitch assembly for railway cars has a multiplanar support beam which coacts with a transverse support plate to tie together and rigidify the components of the pivot mount. The multiplanar support beam and transverse support plate affectively transfer loads imposed upon a pivotal connection to the outside of a center sill which provides the longitudinal and load bearing support for the railway car.

6 Claims, 4 Drawing Figures

MULTIPLANAR SUPPORT BEAM FOR HITCH PIVOT MOUNT

BACKGROUND OF THE INVENTION

1. Field Of Invention

This invention relates to fifth wheel hitch assemblies for railway cars and particularly to an improved pivot mount for mounting such hitches to railway cars.

2. Description Of The Prior Art

Pivot mountings for mounting fifth wheel hitches to the decks of conveyance vehicles such as railway cars or ships have long been used and are well known. Due to the high force loadings placed upon such hitches particularly during acceleration and deceleration of the conveyance vehicle, it has been found desirable to provide reinforcement for the individual components of the pivot mounts to tie the components together in a rigid manner. Previous attempts to provide such a reinforcement means are shown in U.S. Pat. Nos. 3539141 and 4095766. The pivot mount reinforcement members show in these patents are substantially flat or single planar plates and have been found to be generally inadequate to provide sufficient rigidity to the pivot mount. Lacking sufficient rigidity between the components of a pivot mount causes flexure and consequent metal fatigue of the base surface or deck to which the pivot mount is attached.

SUMMARY OF THE INVENTION

This invention relates to an improved reinforcement means for reinforcing and rigidifying a rear pivot mount used to attach a lower end of a diagonal support strut of a fifth wheel hitch assembly to a deck or bearing surface of a conveyance vehicle such as a railway car or ship.

The term "planar" as used herein below defines a member having a pair of flat parallel surfaces lying in essentially parallel planes, such as a flat plate or bar stock. "Multiplanar" defines a member formed of more than one planar sections arranged at an angle to each other.

A multiplanar support beam and a transversely extending plate are securely affixed to each other and to components of a pivot mount to rigidify the components of the pivot mount and transfer loadings imposed upon the pivot mount to end members of the pivot mount whereby the force loadings may be transferred to the exterior surfaces of the main support member which are commonly the longitudinally extending center sill members of a railway flatcar. In some instances it may be desirable to add reinforcing members, such as gussets, between the center sill member and the deck and/or between the deck and components of the pivot mount.

DETAILED DESCRIPTION OF THE PREFERRED EMBODIMENT

Figure 1:
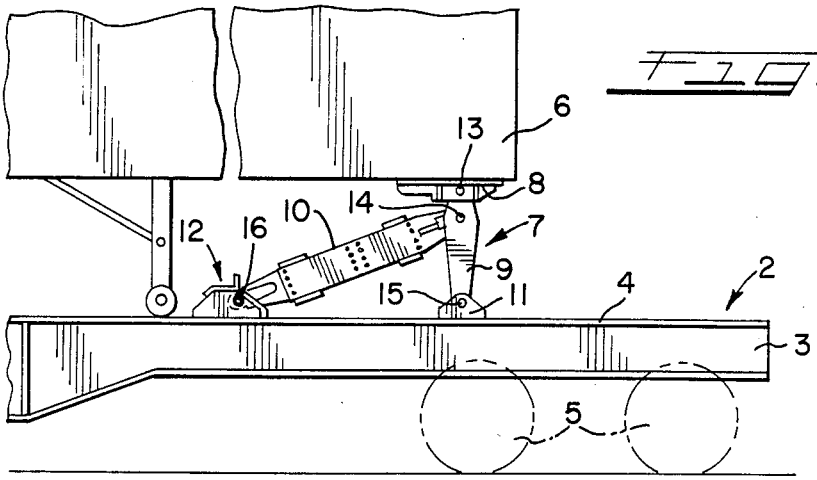
FIG. 1 is a partial side elevation view showing a railway car having a fifth wheel hitch assembly mounted on its deck and showing a rear pivot mount assembly of this invention.

FIG. 1 shown in a partial side elevation view a conveyance or transport vehicle such as railway car having a fabricated longitudinally extending support beam commonly called the center sill of which one member 3 is shown and on which is mounted a support surface or deck 4. A plurality of wheels 5 are generally mounted in a well-known manner to the railway car to enable it to roll over a support surface.

A cargo, such as highway cargo trailer 6, is securely affixed to the railway car 2 by having its kingpin (not shown) lockingly engaged with a fifth wheel hitch assembly 7. Fifth wheel hitch assembly 7 is typically comprised of a fifth wheel support plate 8, a vertical support strut 9, a diagonal rearwardly extending support strut 10, a forward or frontal pivot mount 11 and a rear pivot mount assembly 12. Fifth wheel plate 8 and its associated components are pivotally engaged with vertical support strut 9 by a pivot pin 13 and an upper forward end of diagonal strut 10 is pivotally engaged with the vertical support strut 9 by a pivot pin 14. A lower end of vertical support strut 9 is pivotally engaged with front pivot mount 11 by a pivot pin 15. Similarly, a lower rearward most portion of diagonal support strut 10 is pivotally engaged with rear pivot mount assembly 12 by a pivot pin 16. Diagonal support strut 10 is of the type which absorbs shock loadings to protect the cargo in the highway cargo trailer and therefore vertical pivot strut 9 and diagonal pivot strut 10 undergo limited pivotal movement about pivot pins 15 and 16 during normal travel of the railway vehicle.

Figure 2:
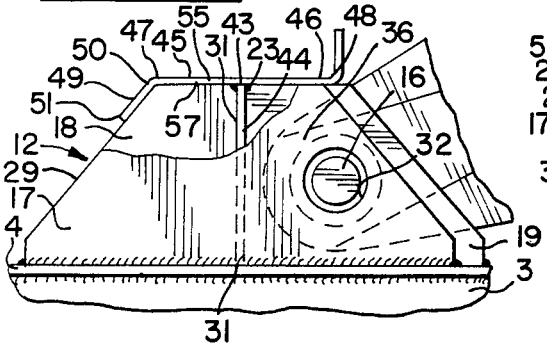
FIG. 2 is a side elevation view showing an enlarged view of the rear pivot mount assembly shown in FIG. 1.
Figure 3:
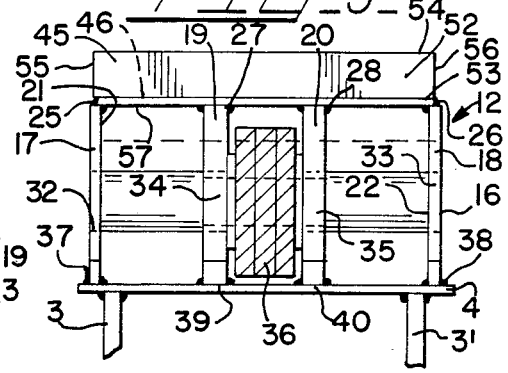
FIG. 3 is an end view of the rear pivot mount shown in FIG. 2.
Figure 4:
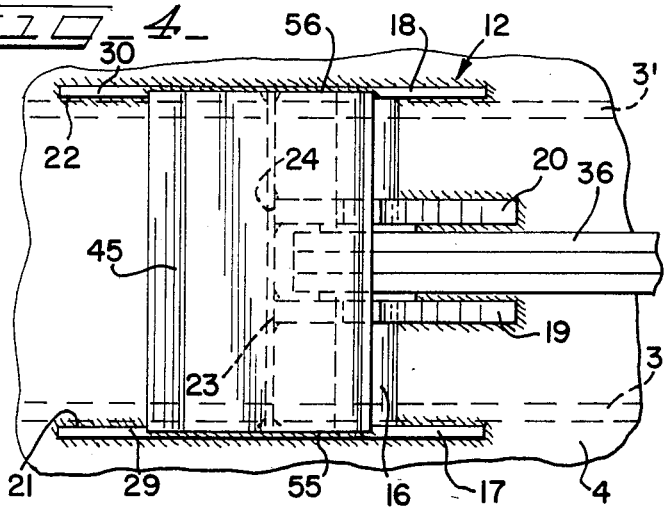
FIG. 4 is a top plan view of the pivot mount shown in FIGS. 1 and 2.

Referring now to FIGS. 2, 3, and 4, which show enlarged side elevation and top views of rear pivot mount assembly 12 shown in FIG. 1, it will be seen that pivot mount assembly 12 is comprised of a first end member 17, a second end member 18, a first lug member 19 and a second lug member 20. As best shown in FIG. 4, end members 17 and 18 are positioned parallel to and spaced from each other and lug members 19 and 20 are placed parallel to and spaced from each other. The pair of lug members 19 and 20 are positioned to be parallel to and intermediate of end members 17 and 18. End members 17 and 18 have inboard or opposed surfaces 21 and 22, respectively. Lug members 19 and 20 each have a rear terminal end 23 and 24, respectively, which are in substantial alignment with each other.

First end member 17 has a top surface 25 and second end member 18 has a top surface 26. Similarly, first lug member 19 has a top surface 27 and second lug member 20 has a top surface 28. As shown, top surfaces 25, 26, 27, and 28 are in substantial elevational alignment with each other. Each end member 17 and end member 18 have a rear sloped surface 29 and 30, respectively. A transverse substantially vertically oriented support plate 31 extends from surface 21 of end member 17 to surface 22 of end member 18 and abuttingly engages the rear terminal end 23 and 24 of lug members 19 and 20, respectively. First end member 17 is provided with a pivot pin opening 32 and second end member 18 is provided with a pivot opening pin 33. Also, first lug member 19 is provided with pivot pin opening 34 and second lug member 20 is provided with a pivot pin opening 35. Pivot pin openings 32, 33, 34, and 35 are in substantial alignment with each other for pivotally receiving a pivot pin 16. As shown in FIGS. 1 through 4 pivot pin 16 pivotally engages an end portion 36 of the lower end of diagonal strut 10 to pivot mount assembly 12.

End members 17 and 18 each have a lower or bottom surface 37 and 38 respectively. Similarly, lug members 19 and 20 each have a lower or bottom surface 39 and 40 respectively. Bottom surfaces 37, 38, 39, and 40 are in substantial elevational alignment with each other and abuttingly engage and are rigidly affixed such as by welding as shown to a base means such as the top of deck 4 of railway car 2.

Transverse vertically oriented reinforcement plate 31 has a first or lower end 42 which abuts and is rigidly affixed to the top surface of deck 4. Plate 31 also has a second or upper end 43 which is in substantial elevational alignment with each of the top surfaces or ends 25 and 26 of end members 17 and 18, respectively, and with the top surfaces or ends 27 and 28 of the lug members 19 and 20, respectively. Transversely oriented plate 31 has a forward facing surface 44 which is in substantial abutting engagement with the end 23 and 24 of the lug members 19 and 20 respectively.

A multiplanar substantially Z-shaped reinforcement member 45 having a lower or downwardly facing surface 57 abuttingly engages and is rigidly affixed to the top surfaces 25 and 26 of each of the end members 17 and 18, respectively, and to the top surfaces 28 and 29 of each of the lug members 19 and 20, respectively. Multiplanar reinforcement member 45 is comprised of a substantially horizontal planar portion 46 having a back or rear end planar portion 47 and a forward or front end portion 48. Formed integral with rear end portion 47 of planar portion 46 is a sloped, downwardly extending rear planar portion 49 of Z-beam 45. Sloped rear planar portion 49 of reinforcement member 45 has a first end portion formed integral with portion 47 of planar portion 46. Sloped portion 49 of reinforcement member 45 has a terminal end 51. A third or frontal planar portion 52 of reinforcement member 45 has a first or lower end 53 which is integral with the forward or front end portion 48 of planar portion 46 of reinforcement member 45. Substantially vertically oriented upwardly extending frontal planar portion 52 of reinforcement member 45 has an upper or terminal end 54. Reinforcement member 45 has a first terminal side 55 which abuttingly engages and is rigidly affixed, such as by welding as shown, to the top surface 25 of end member 17 and a second terminal side 56 which abuttingly engages and is rigidly affixed to the top surface 26 of end member 18.

As shown in FIGS. 2, 3, and 4, each of the end members 17 and 18 and each of the lug members 19 and 20 of pivot mount assembly 12 are rigidly affixed such as by welding to transversely extending substantially vertically oriented reinforcement plate 31. Also, each of the end members 17 and 18 and each of the lug members 19 and 20, as well as plate 23, are rigidly affixed to base means such as deck 4. Planar portion 46 has its lower downward facing surface 57 rigidly affixed to top surface portions of each of the end members 17 and 18 in each of the lug members 19 and 20. Additional reinforcement of the assembly is provided by rear most downwardly sloping planar portion 49 of reinforcement member 45 which is rigidly affixed to downwardly sloping surfaces of each of the end members 17 and 18. Substantially vertically oriented planar portion 52 of reinforcement member 45 serves a dual function. Planar portion 52 coacts with sloped planar portion 49 of reinforcement member 45 together with vertically oriented plate 31 to substantially rigidify the pivot mount assembly 12 against torsional or twisting movement. Also vertically upwardly extending planar portion 52 provides clearance to enable end portion 36 of diagonal strut 10 to rotate to a limited angular degree about pivot pin 16 without interfering with reinforcement member 45 or imposing any loads directly on reinforcement member 45. Thus, as described above, and shown in the drawings, plate 31 and reinforcement member 45 coact to provide structure which forms the end members and the lug members of pivot assembly 12 into a rigid and strong pivot mount.

Pivot assembly 12 is as best shown in FIGS. 3 and 4 typically mounted astraddle the box or center sill members 3 and 3' of the center sill of a railway car. Due to the use of transfer plate 31 and reinforcement member 45, loads placed upon lug members 19 and 20 by diagonal strut 10 acting through pivot pin 16 are effectively transferred or beamed to end members 17 and 18 and the force loadings so transferred are effectively transferred to the center sill members 3 and 3 prime for minimizing flexing and consequent metal fatigue damage to deck 4 of the railway car.

While not shown, it may in some instances be desirable when necessary to provide additional reinforcement means such as gussets between the lug members 3 and 3 prime and the deck 4 as well as between deck 4 and the end members 17 and 18. What is claimed is:

1. A pivot mount for pivotally mounting an end portion of a fifth wheel support strut to a conveyance vehicle, said pivot mount comprising:

a base means;

a pair of end members rigidly affixed to said base means for transferring forces imposed on said pivot mount to said base means, said end members being substantially parallel to each and spaced from each other;

a pair of lug members rigidly affixed to said base means, said lug members being positioned between and substantially parallel to said end members, said lug members being spaced and receiving an end portion of said support strut therebetween for receiving loads therefrom;

a transverse reinforcement plate member rigidly affixed to each of said end members and each of said lug members and to said base means for connecting said members together and for transferring loads received by said lug members to said base means and said end members;

a multiplanar support member rigidly affixed to each of said end members and each of said lug members and said transverse reinforcement plate member to transfer loads received by said lug members to said end members and to substantially rigidify said base means, said end members and said lug members as a pivot mount assembly; and the multiplanar support member including a first planar portion rigidly affixed to each of said end members and each of said lug members and to said transverse reinforcement plate member.

said first planar portion having a rear end, and a second planar portion formed integral with the rear end of the first planar portion and projecting downward therefrom, said first planar portion having a forward end and a third planar portion formed integral with the forward end of the first planar portion and projecting upward therefrom, whereby said multiplanar support member undergoes minimal strain responsive to shear loads received from said lug members and provides for maximum clearance for support strut cushioning movement.

2. The invention as defined in claim 1 in which said base means is the load bearing surface of a cargo vehicle.

3. The invention as defined in claim 1 in which said base means is a separate plate and said plate is affixed to a load bearing portion of a cargo vehicle.

4. The invention as defined in claim 1 in which said members are rigidly affixed to each other by welding.

5. The invention as defined in claim 1 in which said mulitplanar support member is substantially Z shaped.

6. In a pivot mount for pivotally engaging a lower end portion of a diagonal support strut for a fifth wheel hitch assembly to a cargo conveying vehicle, said pivot mount having a pair of end members having a pair of opposed sides, said end members being substantially parallel to each other and spaced from each other for supporting the support strut and receiving loads therefrom, said pivot mount further having a pair of lug members substantially parallel to each other and spaced from each other, said pivot mount further having a pair of lug members substantially parallel to each other and spaced from each other, said pair of lug members being substantially parallel to said end member and placed between said pair of end members, said lug members having substantially aligned rear terminal ends, and each of said end members and said lug members having substantially elevationally aligned bottom surfaces rigidly engaged with a base surface for transmitting loads received from said strut to said base surface, and each of said end members and said lug members having substantially elevationally aligned top surfaces, said pair of end members having a pair of rear sloped substantially aligned surfaces extending downwardly from said top surfaces the improvement comprising:

a transverse plate member having a first end abuttingly engaging and rigidly affixed to one of said opposed sides of one of said end members and a second end abuttingly engaging and rigidly affixed to said other opposed side of said other end member, said plate member abuttingly engaging and being rigidly affixed to said substantially aligned rear terminal ends of said lug members for transferring loads received from said lug members to said end members, said plate member having an upper terminal end portion in substantial elevational alignment with said lug members, and a multiplanar support member having:

(a) a first planar portion having a downward facing surface and a first end portion and a second end portion and a first terminal side and a second terminal side a portion of said downward facing surface abutting and rigidly affixed to a portion of each of said substantially elevationally aligned top surfaces of each of said end members and each of said lug members and also rigidly affixed to said upper terminal end portion of said plate member;

(b) a second planar portion formed integral with said first end portion of said first planar portion and abutting and being rigidly affixed to a portion of each of said aligned pair of rear sloped surfaces of said end members; and (c) a thrid planar portion formed integral with said second end portion of said first planar portion, said third planar portion extending upward from said first planar portion thereby providing maximal clearance for cushioning movement of the diagonal strut;

whereby said multiplanar support member undergoes minimal torsional strain due to shear loads created by the transfer of loads from the lug members to the end members and whereby said transverse plate member and said multiplanar member coact to rigidify said end members and said lug members as a pivot mount assembly.

* * * * *